US005247825A

United States Patent [19]

Erickson

[11] Patent Number: 5,247,825

[45] Date of Patent: Sep. 28, 1993

[54] METHOD OF FORMING PART IN PROGRESSIVE DIE SYSTEM

[75] Inventor: Lawrence Erickson, Royal Oak, Mich.

[73] Assignee: Manufacturers Products Company, Warren, Mich.

[21] Appl. No.: 785,844

[22] Filed: Oct. 31, 1991

[51] Int. Cl.[5] ..... B21D 28/00

[52] U.S. Cl. ..... 72/339; 72/379.2; 72/404; 72/334; 72/338; 29/6.1; 83/50; 83/277

[58] Field of Search ..... 72/404, 334–339, 72/329, 330, 405, 379.2; 83/40, 49, 255, 50, 277; 29/6.1, 6.2

[56] References Cited

U.S. PATENT DOCUMENTS

| | | | |
|---|---|---|---|
| 2,215,658 | 9/1940 | Arens | 29/6.1 |
| 2,989,936 | 6/1961 | Farnsworth | 72/335 |
| 3,380,282 | 4/1968 | Scaletta | 72/335 |
| 3,566,660 | 3/1971 | Dedek | 72/404 |
| 3,765,217 | 10/1973 | Ikeda | 72/404 |
| 3,869,778 | 3/1975 | Yancey | 29/6.1 |
| 4,320,647 | 3/1982 | Kummeling | 72/334 |
| 4,583,436 | 4/1986 | Asano | 83/277 |
| 4,605,279 | 8/1986 | Mixon | 72/404 |

FOREIGN PATENT DOCUMENTS

| | | | |
|---|---|---|---|
| 165239 | 7/1986 | Japan | 72/404 |
| 647658 | 12/1950 | United Kingdom | 29/6.1 |

*Primary Examiner*—Daniel C. Crane
*Attorney, Agent, or Firm*—Dykema Gossett

[57] ABSTRACT

A malleable sheet of material is introduced into a progressive die system having a plurality of stations containing one or more dies for forming a predetermined configuration in the malleable sheet of material as the sheet progresses through the system. At least one strengthening means is formed along the sheet of material at an early station in the progressive die system for strengthening the sheet of material such that the sheet can be controlled at subsequent stations. Die related operations are then performed on the sheet of malleable material by the progressive die system until a completed part is created.

15 Claims, 3 Drawing Sheets

METHOD OF FORMING PART IN PROGRESSIVE DIE SYSTEM

BACKGROUND OF THE INVENTION

This invention relates to a method for forming contoured shaped parts in a progressive die system where the material is particularly malleable and traditionally susceptible to unwanted tears and deformations as it is fed through the system.

Progressive dies (follow dies) are among the oldest and most commonly used type of multiple operation dies. In a progressive die system, a sequence of different forming operations is undertaken which changes the shape of a piece of metal in discrete steps until a final part is created. With a standard progressive-type die, the part being formed is usually carried along with the original metal sheet or coil, until the final station. There is a variant of this procedure, the cut-and-carry die, by which the surrounding strip is almost completely trimmed away, leaving the stampings connected by a small bridge of stock. Thus, they are carried from station to station, until the final station where they are severed. Names for such bridges of stock include carrier strips or strip skeletons.

When a stamping is made, a plunger forces the sheet into a die. The deformed sheet is then removed from the die through the use of spring shedders or the like which contact the part and force its ejection. After the ejection is complete, the part is moved to the next station of the progressive die system.

Unfortunately, under the prior art, progressive die systems have not worked with malleable metal sheets which lack a certain level of intrinsic rigidity unless the carrier strips are wide. Unless such carrier strips are used, when a sheet of malleable material is fed into the progressive die system, it becomes almost impossible to have the sheet maintain a proper orientation because it is so flexible. As a result, when working with such materials, more economical part formation has often involved a single-acting approach, whereby every operation is performed with a separate die and usually on a separate press.

If it were not for the prohibitive costs usually associated with wide carrier strips, there would be major advantages to using a progressive die system with malleable materials. With such a die setup there is no need to inspect between operations; there is a considerable increase in safety; only one press is needed instead of several, resulting in better machine utilization, less floor space, less die setting time and labor, and less supplementary costs; operator time itself is reduced, further resulting in labor cost savings; quicker deliveries are made possible by the increase in production rates which in turn allows for reduced inventories and a corresponding drop in required storage space; and damage due to interoperational handling is eliminated as well as the chance of improper loading.

SUMMARY OF THE INVENTION

This invention relates to a method for forming contoured shaped parts in a progressive die system where the material is particularly malleable and traditionally susceptible to unwanted tears and deformations as it is fed through the system.

When a sheet of malleable material is introduced into a progressive die system, a strengthening means is formed along the sheet at an early station within the progressive die system for strengthening the sheet so that it can be controlled at subsequent stations of the progressive die system. Without the strengthening means, a part cannot be made out of malleable material with the progressive die system unless wide carrier strips are used. This is uneconomical because of the vast waste generated when a strip this size is severed from the part upon its completion.

The strengthening means is formed wherever required. In one application it may be formed along a path parallel to a longitudinal side of the malleable sheet of material while in another it may be at an angle. Because most progressive die setups require at least a minimal carrier strip in order to progressively move a sheet through the system, the strengthening means may also be formed within it, and removed with the carrier strip when the part is complete. In many applications, the strengthening means is spaced so that sufficient malleable material remains to be drawn upon in order to create the part. In other applications, however, the strengthening means may be continuous.

In the preferred embodiment practicing the present invention, the strengthening means is spaced within the carrier strip because of the type of stamping operation performed. In this embodiment, the strengthening means comprises a rib or indentation having side walls parallel to a longitudinal side of the sheet and closed ends. It has been found that in this particular application of the invention the depth of the rib should be at least 2.5 times the thickness of the sheet in order to provide enough strength to the sheet of malleable material.

In short, the disclosed method can be used in the formation of a wide range of parts from malleable materials. While not limited to any one application or material these and other objects and features of the present invention can be best understood from the following specification and drawings, of which the following is a brief description.

DETAILED DESCRIPTION OF A DISCLOSED EMBODIMENT

Figure 1:
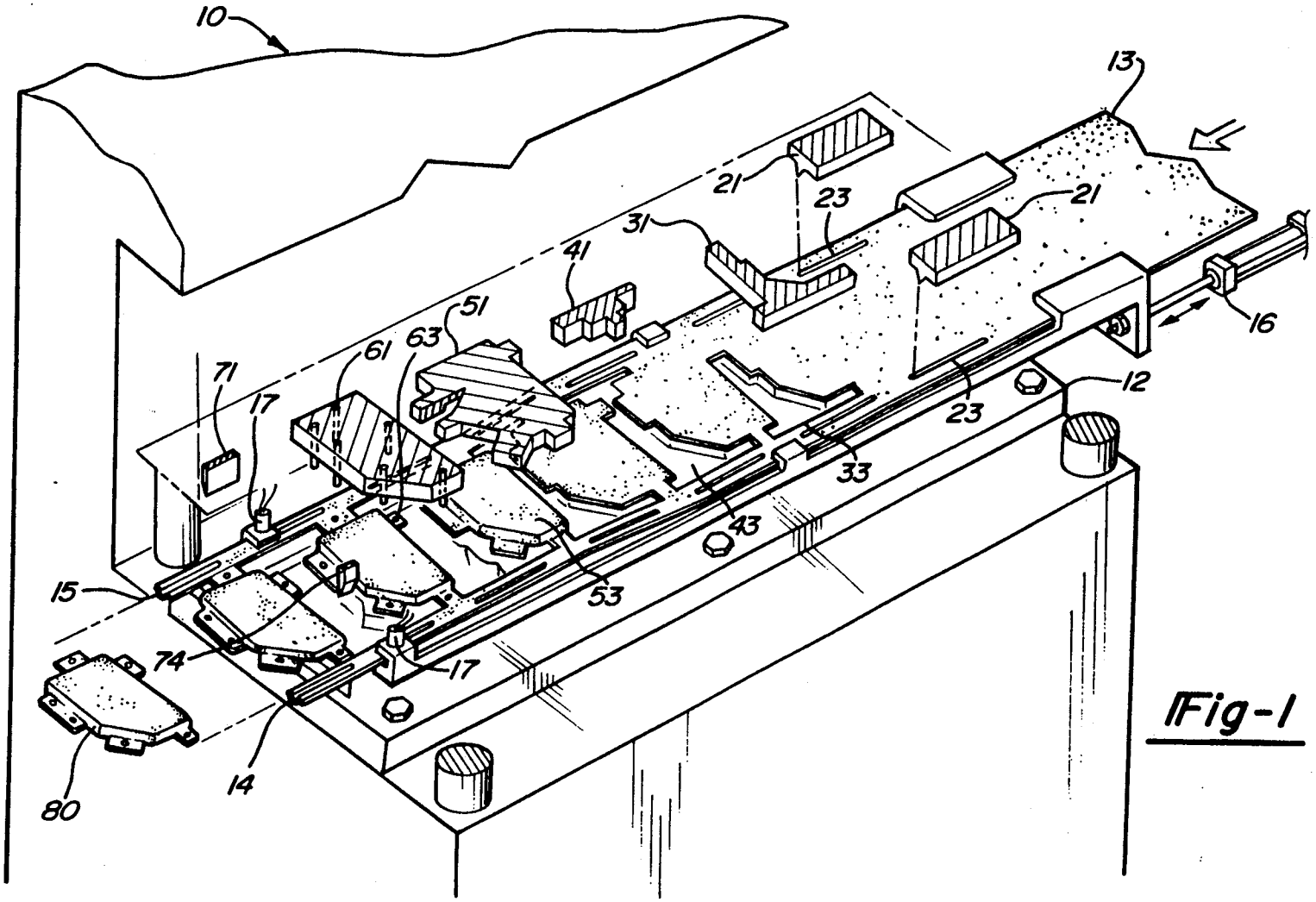
FIG. 1 is a perspective view showing how the present invention might be used in a typical progressive die system.
Figure 2:
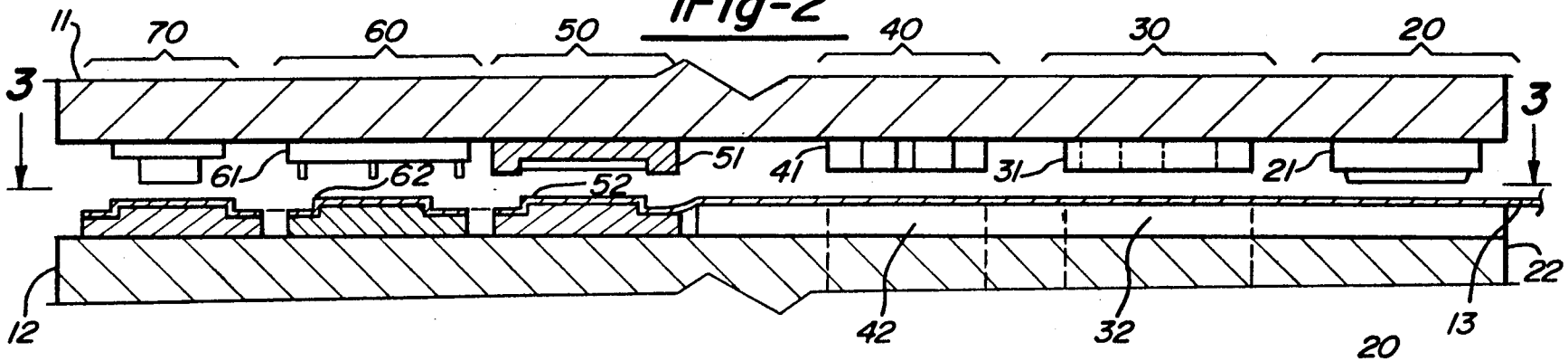
FIG. 2 is a side view showing how the present invention might be used in a typical progressive die system.
Figure 3:
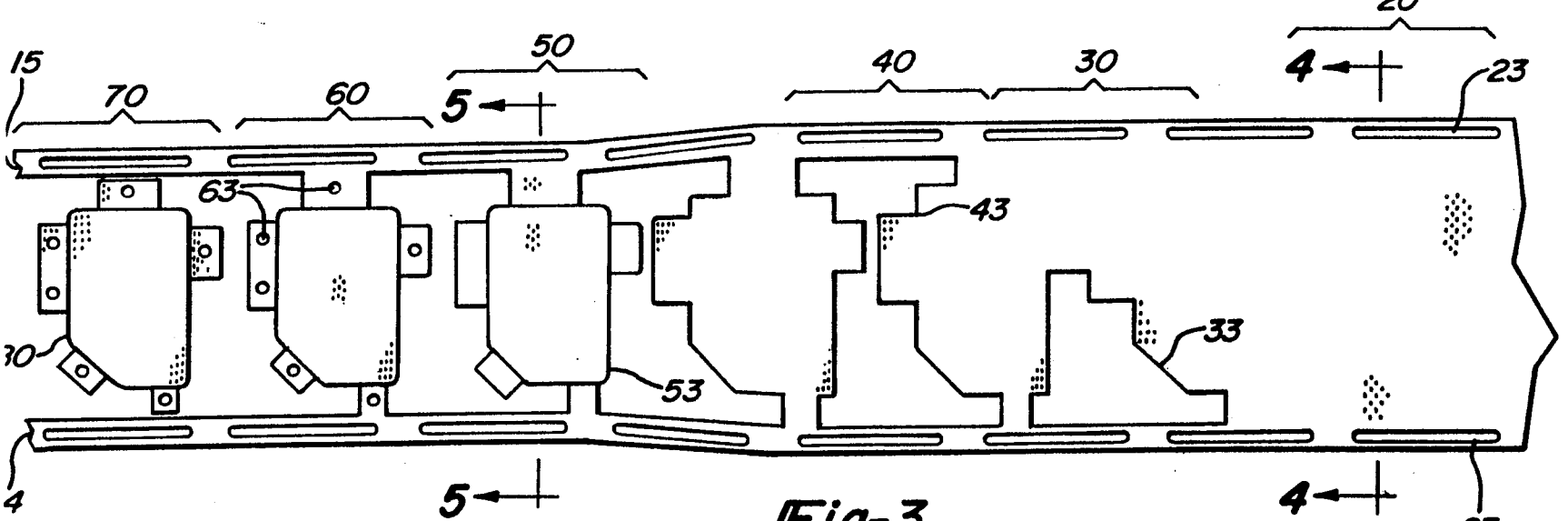
FIG. 3 is a top view of a portion of a sheet of malleable material as it might look at various stations of a typical progressive die system as identified by lines 3 in FIG. 2.
Figure 4:
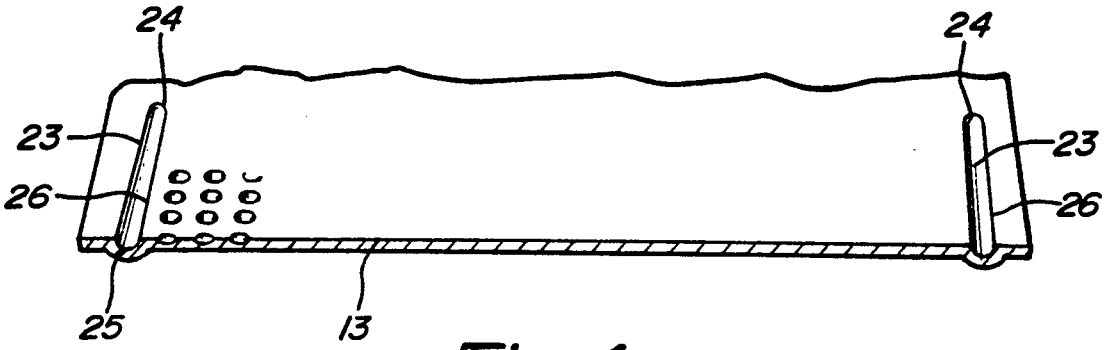
FIG. 4 is a perspective partial front view of a sheet of malleable material focusing on ribs formed within the material as identified by lines 4 in FIG. 3.
Figure 5:
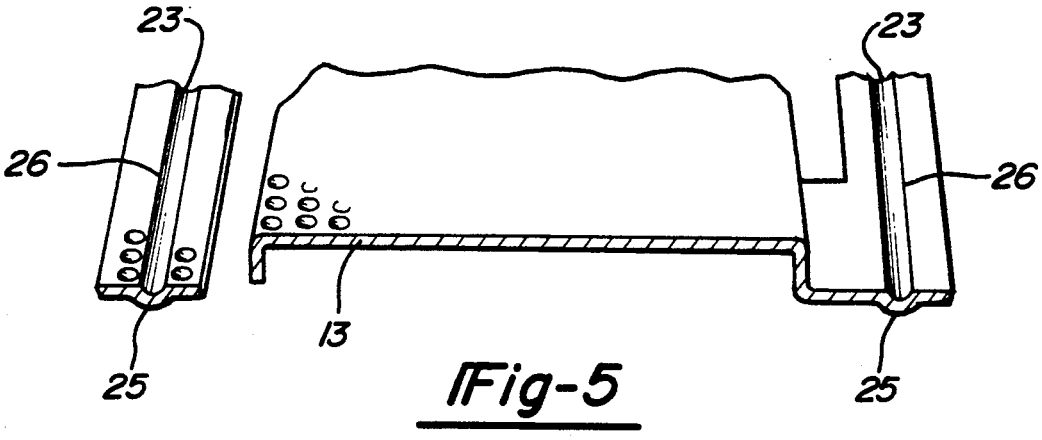
FIG. 5 is a perspective partial front view of a sheet of malleable material after a stamping operation as identified by lines 5 in FIG. 3.

The invention is directed to adding strengthening means to material during the progressive die process. FIG. 1 is a perspective view of a typical progressive die system 10 using the present invention. The figures are not intended to disclose a complete progressive die and familiarity with such dies is presumed. It should be emphasized that the present invention may be practiced with any progressive die and is not limited to the linear system which is disclosed. It should also be understood that the illustration of a speaker grill 80 and particularly the speaker grill being formed is merely an example of what can be made by a progressive die system using the teachings of the present invention. The invention should not be limited except as set forth in the claims.

Referring now more particularly to FIGS. 1-5, in the disclosed embodiment a punch holder 11 and a die shoe 12 are used in conjunction with six progressive die stations in order to convert a sheet 13 of malleable material into a finished product, such as for example a speaker grill 80. For this particular part, the applicant uses a sheet of either SAE 1008 or SAE 1010 steel with a minimum thickness of 0.025 inches. The steel sheet 13 has a pattern of holes in order to create an open area through which sound may be transmitted. These holes are typically pierced out of the material and have diameters of 0.038 inches on staggered centers. Expanded sheet metal can be used as well.

Moving right to left, sheet 13 enters first station 20 in its unaltered form, where two ribs 23 are formed by drawing punches 21 in conjunction with drawing dies 22 along each of the two longitudinal sides of sheet 13 within carrier strips 14 and 15. Carrier strips 14 and 15 work in conjunction with reciprocating pistons 16 and releasable members 17 to progressively move sheet 13 from station to station within the progressive die system 10.

Rib 23 is fundamental to the successful practicing of the present invention. It serves a strengthening function, providing rigidity to sheet 13, preventing unwanted bendings and deformations. Sheet 13 may thus be correctly and reliably positioned at each station of the progressive die system using methods known in the art until a completed part is formed. Further, since rib 23 is formed in scrap material, carrier strips 14 and 15 being removed upon part completion, its function need not be incorporated within the part itself.

With respect to this particular part, preferably rib 23 has side walls 26 longitudinal to the die path that are closed at ends 24. The preferred depth of rib 23 in making speaker grill 80 is at least 2.5 times the thickness of sheet 13 and has a radius of curvature 25. This radius is advantageous because it reduces the possibility of rips or tears on rib 23 when it is formed.

While carrier strips 14 and 15 are shown along each of the edges of sheet 13 longitudinal to the die path, the disclosed embodiment using the present invention is not restricted to this approach. Limiting rib 23 to at most a single carrier strip may be preferable under some circumstances. In many progressive die systems multiple carrier strips are not even present, replaced instead by a single strip present roughly in the center of sheet 13. Under such circumstances rib 23 would still provide necessary support.

Finally, while rib 23 may be uninterruptably present along an entire carrier strip, in this embodiment rib 23 is sized such that sufficient malleable material remains to be drawn upon to aid in part formation. The deformation of carrier strips 14 and 15 under this particular progressive die system can best be seen in FIG. 3, at the fourth station 50. As illustrated, the outer edges of sheet 13 are angled inwardly at the fourth station 50 due to the drawing effect.

At the second station 30, perforating punch 31 works in conjunction with perforating die block 32 in order to form pierced hole 33. At the third station 40, perforating punch 41 works in conjunction with perforating die block 42, in order to form pierced hole 43. At the fourth station 50, drawing die 51 works in conjunction with drawing punch 52 in order to make a stamped speaker grill 53. At the fifth station 60, circular holes 63 are formed by piercing punch 61 in conjunction with piercing die block 62. Finally, at the sixth station 70, piercing punches 71 and 74 work in conjunction with piercing die blocks 72 and 75 in order to remove the part from carrier strips 14 and 15, creating finished speaker grill 80.

An embodiment showing the practice of the present invention has been disclosed. A worker of ordinary skill in the art would realize, however, that certain modifications of this invention would be obvious from the teachings of this application. For example, the strengthening function provided by rib 19 could be provided by rolling the longitudinal edges of sheet 203 laterally inward. Further, different malleable materials could be used depending on the part being formed and its application. Thus, the following claims should be studied in order to determine the true scope and content of the invention.

I claim:

1. A method for forming a part from malleable material in a progressive die system, said method comprising the steps of:

(A) introducing a malleable substantially planar sheet of material into a progressive die system by moving said material in a longitudinal direction along a path substantially parallel to lateral edges of said sheet of material, said progressive die system having a plurality of stations each containing one or more dies for forming a predetermined configuration in said malleable sheet of material as said sheet of material progresses through said die system;

(B) forming at least two laterally spaced strengthening ribs extending out of the plane of the sheet of material adjacent to lateral edges of said sheet of material at an early station in said progressive die system for strengthening said sheet of material such that said sheet of material can be controlled at subsequent stations of said progressive die system; and (C) performing die related operations on said sheet of malleable material between and separate from said ribs by said progressive die system as said sheet material is fed through said stations including removing a completed part from said sheet between said ribs without including any of said ribs in said completed part.

2. The method according to claim 1, wherein said strengthening ribs are formed along a least one path parallel to said lateral edges of said malleable sheet of material.

3. The method according to claim 1, wherein said strengthening ribs have distinct spaced portions along said sheet such that sufficient malleable material remains between said spaced portions to be drawn upon in order to create said part.

4. The method according to claim 1, wherein said strengthening ribs include side walls parallel to said lateral edges, said sidewalls being closed at their longitudinal ends, such that they do not extend out of the plane of said sheet of material at said longitudinal ends.

5. The method of claim 4, wherein the depth of each of said ribs is defined as the distance said rib extends out of the planar sheet of material, and is at least 2.5 times the thickness of said sheet.

6. The method according to claim 1, wherein the depth of each of said ribs is defined as the distance said rib extends out of the planar sheet of material, and is generally 2.5 times the thickness of said sheet.

7. The method according to claim 4, wherein said rib has a radius of curvature.

8. The method according to claim 1, wherein said malleable material is metal.

9. The method according to claim 8, wherein said metal is steel.

10. The method according to claim 1, wherein said sheet is pierced with a plurality of holes.

11. The method according to claim 1, wherein said sheet is expanded sheet metal.

12. The method according to claim 1, wherein said sheet has an upper and lower face, and the drawing die used to create said strengthening means contacts said upper face while all other drawing dies contact said lower face of said sheet.

13. The method according to claim 1, wherein said strengthening ribs are not continuous along said sheet.

14. A method for forming a part from malleable material in a progressive die system, said method comprising the steps of:

(A) introducing a malleable substantially planar sheet of material into a progressive die system by moving said material in a longitudinal direction along a path substantially parallel to lateral edges of said sheet of material, said progressive die system having a plurality of stations each containing one or more dies for forming a predetermined configuration in said malleable sheet of material as said sheet of material progresses through said die system;

(B) forming at least one laterally spaced strengthening rib extending out of the plane of the sheet of material at an early station in said progressive die system for strengthening said sheet of material such that said sheet of material can be controlled at subsequent stations of said progressive die system; and (C) performing die related operations on said sheet of malleable material laterally spaced and separate from said at least one rib by said progressive die system as said sheet material is fed through said stations, including removing a completed part from said sheet laterally spaced from said rib, and without including any of said rib in said completed part.

15. A method as recited in claim 14, wherein said strengthening rib includes side walls parallel to said lateral edges, said sidewalls being closed at their longitudinal ends, such that they do not extend out of the plane of said sheet of material at said longitudinal ends.

* * * * *